US006557986B2

(12) United States Patent
Watanabe et al.

(10) Patent No.: US 6,557,986 B2
(45) Date of Patent: May 6, 2003

(54) INK JET HEAD AND METHOD FOR THE MANUFACTURE THEREOF

(75) Inventors: Osamu Watanabe, Kumamoto (JP); Koji Matsuo, Fukuoka (JP); Kenji Tomita, Kumamoto (JP); Isaku Kanno, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/191,614

(22) Filed: Jul. 9, 2002

(65) Prior Publication Data

US 2002/0174542 A1 Nov. 28, 2002

Related U.S. Application Data

(62) Division of application No. 09/744,317, filed as application No. PCT/JP00/03341 on May 24, 2000, now Pat. No. 6,447,106.

(30) Foreign Application Priority Data

May 24, 1999 (JP) ..... 11-142613

(51) Int. Cl.[7] ..... B41J 2/045; H04R 17/00

(52) U.S. Cl. ..... 347/70; 29/25.35

(58) Field of Search ..... 29/25.35, 890.1; 347/70, 68, 71

(56) References Cited

U.S. PATENT DOCUMENTS

| | | | | |
|---|---|---|---|---|
| 5,802,686 A | * | 9/1998 | Shimada et al. | 29/25.35 |
| 6,217,158 B1 | | 4/2001 | Kanaya et al. | 347/70 |
| 6,361,154 B1 | | 3/2002 | Watanabe et al. | 347/70 |
| 6,374,482 B1 | * | 4/2002 | Mihara et al. | 29/611 |

FOREIGN PATENT DOCUMENTS

| | | |
|---|---|---|
| JP | 6-297720 A | 10/1994 |
| JP | 6-297720 | 10/1994 |
| JP | 10-180939 A | 7/1998 |
| JP | 10-180939 | 7/1998 |
| JP | 10-181015 | 7/1998 |
| JP | 10-181015 A | 7/1998 |
| JP | 11-78004 A | 3/1999 |
| JP | 11-87791 A | 3/1999 |
| JP | 11-078004 | 3/1999 |
| JP | 11-087791 | 3/1999 |
| JP | 11-105281 A | 4/1999 |
| JP | 11-105281 | 4/1999 |
| JP | 11-115185 | 4/1999 |
| JP | 11-115185 A | 4/1999 |
| JP | 11-334063 A | 12/1999 |
| JP | 11-334063 | 12/1999 |
| JP | 2000-62173 A | 2/2000 |
| JP | 2000-062173 | 2/2000 |
| JP | 3019845 P | 3/2000 |
| WO | WO 98-46429 | 10/1998 |
| WO | 98/46429 A1 | 10/1998 |

OTHER PUBLICATIONS

International Search Report PCT/JP00/03341; JPO; Aug. 18, 2000.

* cited by examiner

*Primary Examiner*—Thinh Nguyen
(74) *Attorney, Agent, or Firm*—Harness, Dickey & Pierce, PLC

(57) ABSTRACT

In order to provide a miniaturized ink jet head having a piezoelectric actuator 21 by which ink in a pressure chamber 3 is emitted and to improve its productivity and reliability, a vibration plate 22 is made up of two layers having different Young's moduli, i.e., a layer 27 having a smaller Young's modulus and a layer 28 having a greater Young's modulus. Further, the Young's modulus of each of the layers 27 and 28 is set at values ranging from 50 GPa to 350 GPa and the total thickness of the vibration plate 22 is set at values ranging from 1 $\mu$m to 7 $\mu$m.

4 Claims, 7 Drawing Sheets

INK JET HEAD AND METHOD FOR THE MANUFACTURE THEREOF

CROSS-REFERENCE TO RELATED APPLICATIONS

This application is a divisional of U.S. patent application Ser. No. 09/744,317 filed on Jan. 19, 2001 now U.S. Pat. No. 6,447,106, which is a 371 of PCT/JP00/03341, filed May 24, 2000. The disclosure(s) of the above application(s) is (are) incorporated herein by reference. This application claims the benefit of Japanese application serial number 11-142,613, filed May 24, 1999.

TECHNICAL FIELD

The present invention relates to an ink jet head for use in ink jet printers and to a method for the manufacture of such an ink jet head. The technical field of the present invention pertains particularly to an ink jet head of the type of emitting ink by a piezoelectric actuator having a structure-improved vibration plate.

BACKGROUND ART

In recent years, the ink jet printer has been used widely for business/home use. In order to meet recent demands for noise reduction, printing quality improvement, et cetera, several methods have been proposed for ink jet heads for use in ink jet printers. Generally, ink jet heads can be classified roughly into the following two types.

In the first type, a portion of a flowpath or a portion of an ink chamber is formed, as a pressure chamber, by a piezoelectric actuator having a piezoelectric element. Then, a pulse-like voltage is applied to the piezoelectric element, thereby causing the piezoelectric actuator to undergo deformation. As a result, the pressure chamber is so deformed that its volume is reduced. This generates in the pressure chamber a pressure pulse which forces droplets of ink to be emitted from a nozzle in communication with the pressure chamber.

In the second type, a heat generating resistor is disposed in a flowpath. A pulse-like voltage is applied to the heat generating resistor. The heat generating resistor generates heat, thereby bringing the ink in the flowpath to the boil to generate vapor bubbles. Droplets of the ink are emitted from a nozzle by the pressure of the generated vapor bubbles.

The present invention pertains to the first type. Therefore, the first type is further described in detail. Referring to FIGS. 9 and 10, there is shown an ink jet head as an example of the first type. This ink jet head is provided with a head main body 101 in which a plurality of recessed portions 102 for pressure chambers are formed. Each recessed portion 102 has a supply opening 102*a* for supplying ink and an emission opening 102*b* for emitting the ink. The recessed portions 102 of the head main body 101 are arranged such that they are spaced at specified intervals in one direction.

The head main body 101 is made up of a pressure chamber component 105 defining sidewalls of the recessed portion 102, an ink flowpath component 106 defining a bottomwall of the recessed portion 102 and formed by lamination of a plurality of thin plates, and a nozzle plate 113. Formed in the ink flowpath component 106 are an ink flowpath 107 for supply which is connected to the supply opening 102*a* of the recessed portion 102 and an ink flowpath 108 for emission which is connected to the emission opening 102*b* of the recessed portion 102. Each ink flowpath 107 is connected to an ink supply chamber 110 extending in the direction in which the recessed portions 102 are arranged. The ink supply chamber 110 is connected to an ink supply aperture 111 formed through the pressure chamber component 105 and the ink flowpath component 106 and connected to an ink tank (not shown). Formed through the nozzle plate 113 is a nozzle aperture 114 connected to the ink flowpath 108.

A piezoelectric actuator 121 is provided atop the pressure chamber component 105 of the head main body 101 in a corresponding fashion to the recessed portion 102. Each piezoelectric actuator 121 has a vibration plate 122 blocking up the recessed portion 102 of the head main body 101 to form, together with the recessed portion 102, a pressure chamber 103. This vibration plate 122 is common to all the piezoelectric actuators 121, serving also as a lower electrode common to all piezoelectric elements 123 which will be described later. Each piezoelectric actuator 121 has a piezoelectric element 123 provided at a portion of the top surface of the vibration plate 122 corresponding to the pressure chamber 103 and an upper electrode 124 provided atop the piezoelectric element 123 for the application of voltage to the piezoelectric element 123.

In the piezoelectric actuator 121, when a pulse-like voltage is applied, through the vibration plate 122 acting as a lower electrode and the upper electrode 124, to the piezoelectric element 123, the piezoelectric element 123 shrinks in a direction perpendicular to its thickness direction, whereas neither the vibration plate 122 nor the upper electrode 124 shrinks. As a result, a portion of the vibration plate 122 corresponding to the piezoelectric element 123 is deflected and deformed by the so-called bimetal effect, being formed into a convex shape toward the pressure chamber 103. This deflection/deformation generates a pressure in the inside of the pressure chamber 103. By this pressure, the ink in the pressure chamber 103 is emitted outside from the nozzle aperture 114 by way of the emission opening 102*b* and the ink flowpath 108.

Recently, various attempts have been made for further improvements in order to meet severe demands for size/weight reduction, drive voltage reduction, noise reduction, cost reduction, and improvement in ink emission controllability. With a view to achieving further miniaturization and high performance, there has been made the attempt that the vibration plate and the piezoelectric element are formed of thin films capable of easily being subjected to fine processing (capable of easily being down-sized and precisely processed).

However, if reduction in film thickness is tried by simply employing materials, shapes, and configurations of conventional piezoelectric actuators, this will produce problems such as the occurrence of cracking in the vibration plate, piezoelectric element, or upper electrode, film debonding, film expansion, at the time of manufacture, therefore leading to the drop in ink jet head productivity.

Additionally, also at the time when the ink jet head is in use, such simple reduction in film thickness inevitably results in the drop in mechanical strength because the thickness of each portion is thin. Therefore, cracking is likely to occur in the vibration plate which frequently undergoes deformation, thereby reducing the life of the ink jet head. Therefore, there have been demands for the realization of an ink jet head which is miniaturized and achieves high performance in ink emission amount controllability and, in addition, which provides longer life because of excellent component strength and is easy to manufacture.

Bearing in mind the above points, the present invention was made. Accordingly, an object of the present invention is to provide an ink jet head of the type that ink in a pressure chamber is emitted by a piezoelectric actuator which is miniaturized and improved in productivity and reliability as high as possible by providing a devised structure for a vibration plate of the piezoelectric actuator.

DISCLOSURE OF THE INVENTION

In order to achieve the above object, in the present invention the vibration plate is made up of at least two layers having different Young's moduli. Alternatively, the vibration plate is made up of at least one compressive residual stress layer having a compressive residual stress and at least one tensile residual stress layer having a tensile residual stress.

The present invention provides an ink jet head comprising:

a head main body with a recessed portion for a pressure chamber formed therein, the recessed portion having a supply opening for supplying ink and an emission opening for emitting the ink; and a piezoelectric actuator including a vibration plate blocking up the recessed portion of the head main body so as to form, together with the recessed portion, the pressure chamber, a piezoelectric element provided on a portion of a side of the vibration plate opposite the head main body and corresponding to the pressure chamber, and an electrode, provided at a side of the piezoelectric element opposite the vibration plate, for the application of voltage to the piezoelectric element, wherein, when a voltage is applied, through the electrode, to the piezoelectric element, the portion of the vibration plate corresponding to the pressure chamber undergoes deformation, thereby causing ink in the pressure chamber to be emitted out of the emission opening;

wherein the vibration plate of the piezoelectric actuator is formed by laminating together at least two layers having different Young's moduli in the thickness direction of the vibration plate.

As a result of such a structure, the vibration plate is composed of at least two different materials. Therefore, when the layers of the vibration plate are formed, they produces different internal stresses (strains), and in the entire vibration plate the internal stresses (strains) are cancelled. As a result, excessive stress concentration to the vibration plate, the piezoelectric electric element, et cetera can be suppressed. Accordingly, even when the vibration plate and the piezoelectric element are reduced in thickness, they are prevented from cracking at the time of their film formation and when being used, therefore achieving improvement in productivity and reliability.

It is preferable that the Young's modulus of each of the layers of the vibration plate is set at values ranging from 50 GPa to 350 GPa. This not only provides an amount of deflection sufficient enough to cause ink to be emitted but also makes it possible to provide a sufficient increase in the generated pressure affecting the ink emission rate. Therefore, the ink jet head superior in ink emission performance will be obtained.

It is preferable that at least one of the layers of the vibration plate nearmost the head main body is made of a material having ink corrosion resistance. As a result of such arrangement, even when the vibration plate is constructed such that it is brought into direct contact with ink, neither expansion/shrinkage nor deterioration by the ink occurs, and even when used for a long time, cracking or the like is unlikely to occur.

It is preferable that the ink corrosion resistant material is made of one of simple substances of copper, nickel, chromium, titanium, molybdenum, stainless steel, and tungsten, one of oxides, nitrides, and carbides of the simple substances, or an alloy selected from a group of alloys containing the simple substances, respectively. As a result of such arrangement, the vibration plate which is thin but strong can be obtained easily and dissolution/corrosion caused by ink can be prevented without fail. Further, it is possible to sufficiently increase the pressure that is generated in the pressure chamber.

It is preferable that the total thickness of the vibration plate is set at values ranging from 1 $\mu$m to 7 $\mu$m. This is because if the total thickness of the vibration plate is below 1 $\mu$m it becomes difficult to secure the strength of the vibration plate and the pressure that is generated in the pressure chamber becomes insufficient, while on the other hand if the total thickness is above 7 $\mu$m there occurs film debonding or cracking at the film formation time and the amount of deflection necessary for the emission of ink cannot be obtained sufficiently. Therefore, it is possible to improve the ink jet head productivity and reliability as well as the ink emission performance to a further extent.

The present invention provides another ink jet head comprising:

a head main body with a recessed portion for a pressure chamber formed therein, the recessed portion having a supply opening for supplying ink and an emission opening for emitting the ink; and a piezoelectric actuator including a vibration plate blocking up the recessed portion of the head main body so as to form, together with the recessed portion, the pressure chamber, a piezoelectric element provided on a portion of a side of the vibration plate opposite the head main body and corresponding to the pressure chamber, and an electrode, provided at a side of the piezoelectric element opposite the vibration plate, for the application of voltage to the piezoelectric element, wherein, when a voltage is applied, through the electrode, to the piezoelectric element, the portion of the vibration plate corresponding to the pressure chamber undergoes deformation, thereby causing ink in the pressure chamber to be emitted out of the emission opening;

wherein the vibration plate of the piezoelectric actuator is formed by laminating together at least one compressive residual stress layer having a compressive residual stress and at least one tensile residual stress layer having a tensile residual stress in the thickness direction of the vibration plate.

As a result of such arrangement, in the case that the vibration plate is formed of the foregoing residual stress layers, the vibration plate will be prevented from being formed by crystal growth in one direction, thereby relaxing strain generated from in-crystal defect and opening gap and suppressing the occurrence of film debonding. As a result, the acceptable good ratio at the ink jet head manufacture time will be improved and, in addition, the ink jet head life will be increased. Accordingly, it is possible to achieve improvements in ink jet head productivity and reliability.

It is preferable that the residual stress of the compressive residual stress layer of the vibration plate is set at 300 GPa or below, and that the residual stress of the tensile residual stress layer of the vibration plate is set at 200 GPa or below. The reason is that if the residual stress of the compressive residual stress layer is greater than 300 GPa, then the compressive stress is increased to an excessive extent, resulting in the occurrence of cracking and debonding in the vibration plate. On the other hand, if the residual stress of the tensile residual stress layer is greater than 200 GPa, then the film becomes cloudy or is colored black, failing to become a normal mirror finished film and therefore being incapable of functioning as a vibration plate. Accordingly, it is possible to maintain the performance of an ink jet head at an excellent level while improving its productivity and reliability.

It is preferable that both of the residual stress layers of the vibration plate are made of the same material having ink corrosion resistance. As a result of such arrangement, even when the vibration plate is constructed such that it is brought into direct contact with ink, neither expansion/shrinkage nor deterioration by the ink occurs, and even when used for a long time, cracking or the like is unlikely to occur. Moreover, the adhesion between the residual stress layers can be increased to a maximum extent.

It is preferable that the ink corrosion resistant material is made of one of simple substances of copper, nickel, chromium, titanium, molybdenum, stainless steel, and tungsten, one of oxides, nitrides, and carbides of the simple substances, or an alloy selected from a group of alloys containing the simple substances, respectively. As a result of such arrangement, the vibration plate which is thin but strong can be obtained easily and dissolution/corrosion caused by ink can be prevented without fail. Further, it is possible to sufficiently increase the pressure that is generated in the pressure chamber.

It is preferable that the total thickness of the vibration plate is set at values ranging from 1 $\mu$m to 7 $\mu$m. As a result of such arrangement, it becomes possible to secure the strength of the vibration plate as well as to sufficiently increase the pressure that is generated in the pressure, and neither film debonding nor cracking occurs at the film formation time. In addition, the amount of deflection necessary for the emission of ink can be obtained sufficiently. It is therefore possible to further improve not only the ink jet head productivity/reliability but also the ink emission performance.

The present invention provides a method for the manufacture of an ink jet head in which ink in a pressure chamber is emitted by causing a vibration plate to undergo deformation by the piezoelectric effect of a piezoelectric element, the ink jet head manufacture method comprising the steps of:

- forming on a substrate an electrode and the piezoelectric element in a superposed manner with the electrode disposed nearer to the substrate;
- forming on the piezoelectric element the vibration plate by laminating together at least one compressive residual stress layer having a compressive residual stress and at least one tensile residual stress layer having a tensile residual stress in the thickness direction of the vibration plate by a sputter technique;
- adhering together the vibration plate and a pressure chamber component defining the pressure chamber; and
- after the adhering step, removing the substrate.

Since the vibration plate is formed by sputtering such as high frequency sputtering, DC sputtering, et cetera, this makes it possible to perform accurate control of the film thickness of each layer by time management. In addition, it is possible to form the residual stress layers by performing adequate control of the film stress by changing parameters, such as the substrate temperature, sputter gas pressure, sputter power, TS interval (the target/substrate distance), of various sputter conditions. At this time, none of film expansion, film debonding, and the like will occur in components such as the vibration plate and the piezoelectric element, as described above. Further, sputtering, being suitable for mass production, may be used to form not only the vibration plate but also the electrode and piezoelectric element. Therefore, it is possible to manufacture inexpensive ink jet heads at a greater yield in large quantities.

It is preferable that the residual stress of the compressive residual stress layer of the vibration plate is set at 300 GPa or below, and that the residual stress of the tensile residual stress layer of the vibration plate is set at 200 GPa or below. As a result of such arrangement, it is possible to maintain the performance of an ink jet head at an excellent level while improving its productivity and reliability, as described above.

It is preferable that the compressive and tensile residual stress layers of the vibration plate are formed by control of the pressure of a sputter gas. This makes it possible to perform control of the in-film stress state in a much easier way, and the compressive and tensile residual stress layers can be formed easily. Gas pressure control is determined by the amount of gas (for example, Ar gas) introduced and the amount of opening of an orifice of a vacuum pump. The operation is accurately controllable and has repeatability, therefore improving the ink jet head productivity to a further extent.

BEST MODE FOR CARRYING OUT THE INVENTION

Embodiment 1

Figure 1:
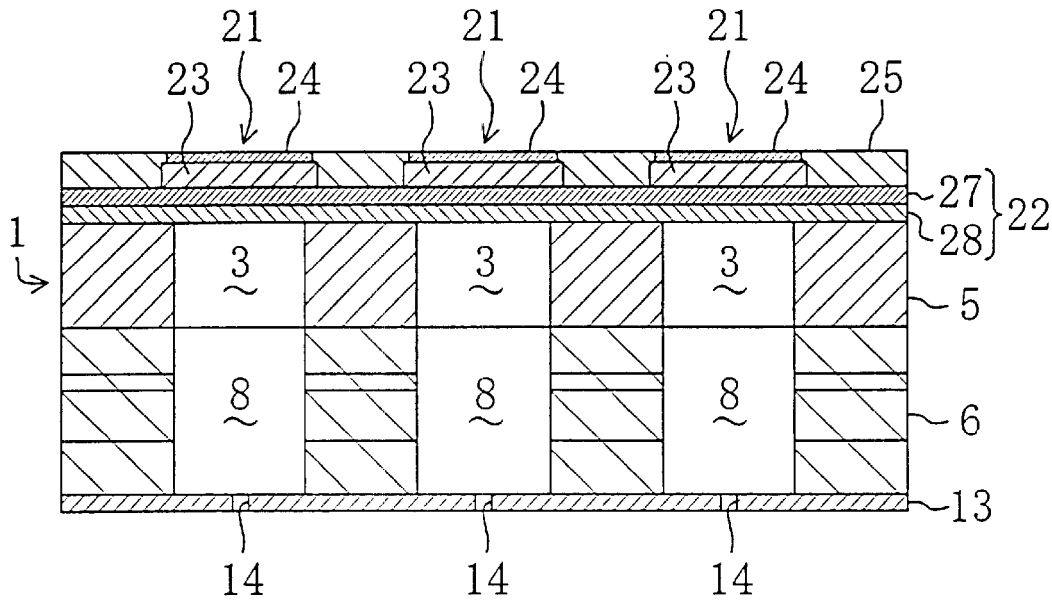
FIG. 1 is a cross-sectional view of an ink jet head according to a first embodiment of the present invention when cut off in the crosswise direction of a piezoelectric element (taken along line I—I of FIG. 3).
Figure 2:
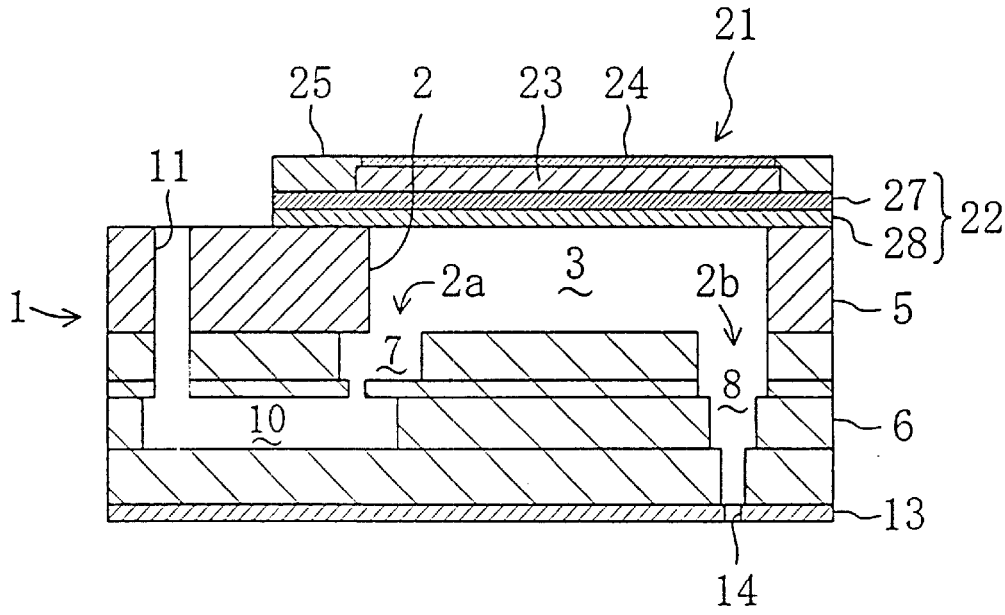
FIG. 2 is a cross-sectional view of the ink jet head of the first embodiment when cut off in the lengthwise direction of the piezoelectric element (taken along line II—II of FIG. 3).
Figure 3:
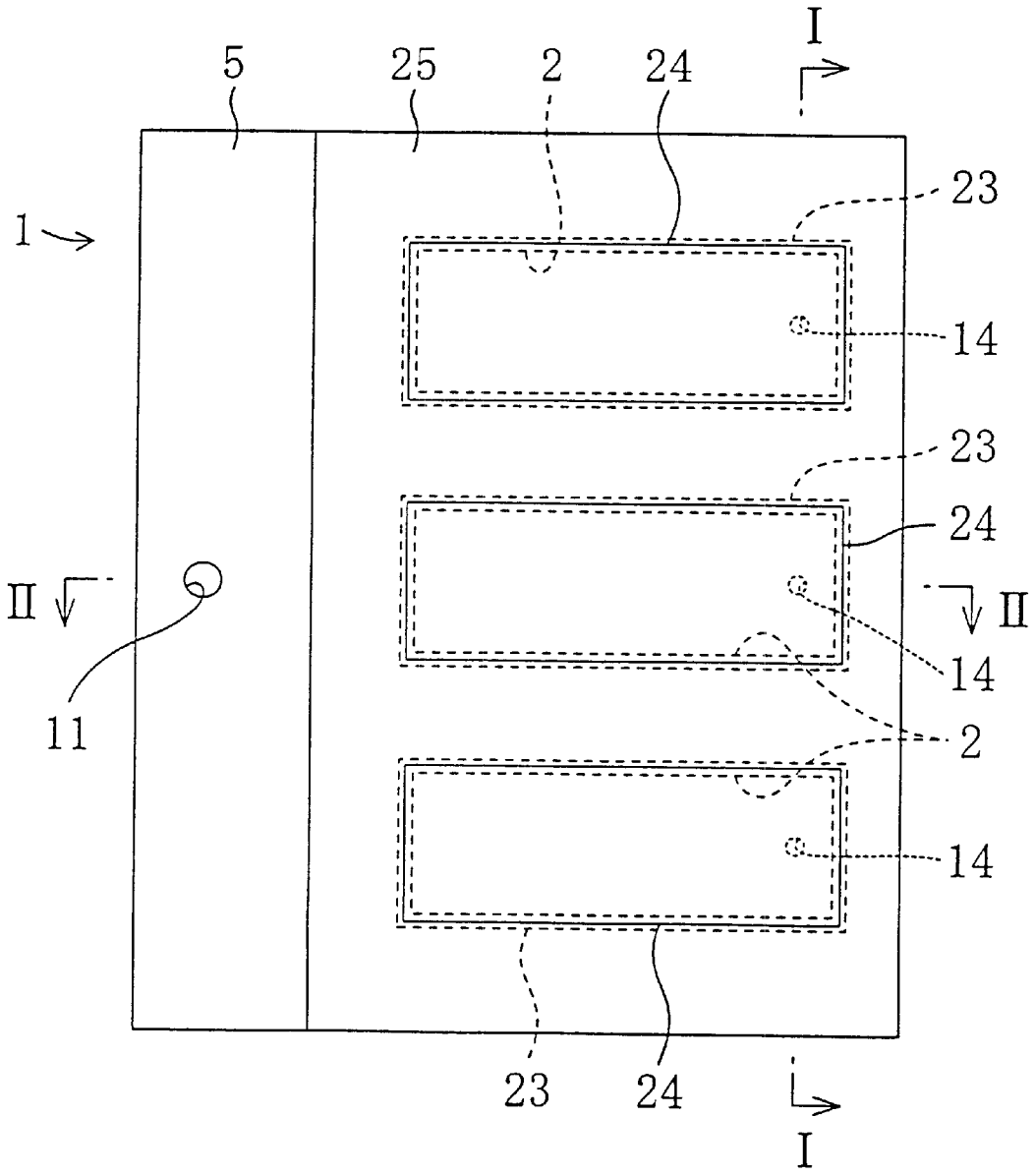
FIG. 3 is a top plan view of the ink jet head of the first embodiment.

Referring to FIGS. 1–3, there is shown an ink jet head according to a first embodiment of the present invention. The ink jet head of the present embodiment is provided with a head main body 1 with a plurality of recessed portions 2 for pressure chambers formed therein, each of the recessed portions 2 having a supply opening 2*a* for supplying ink and an emission opening 2*b* for emitting the ink. The recessed portions 2 of the head main body 1 are each opened in one of outer surfaces (i.e., a top surface) of the head main body 1, being formed into a substantially rectangular shape, and are arranged at specified intervals in the crosswise direction of the openings. Although in FIG. 3 only three of the recessed portions 2 (three of nozzle apertures 14, three of piezoelectric elements 23, and three of upper electrodes 24 which will be described later) are shown for the sake of simplification, these components are actually provided in large quantities.

Sidewalls of the recessed portion 2 of the head main body 1 is formed by a pressure chamber component 5 of stainless steel or photosensitive glass having a thickness of from 200 μm to 500 μm and a bottomwall of the recessed portion 2 is formed by an ink flowpath component 6 adhered to the pressure chamber component 5 and formed by lamination of a plurality of thin plates of stainless steel. Formed in the ink flowpath component 6 are an ink flowpath 7 for supply connected to the supply opening 2*a* of the recessed portion 2 and an ink flowpath 8 for emission connected to the emission opening 2*b* of the recessed portion 2. Each ink flowpath 7 for supply is linked to an ink supply chamber 10 extending in a direction in which the recessed portions 2 are arranged. The ink supply chamber 10 is connected to an ink supply aperture 11 formed through the pressure chamber component 5 and the ink flowpath component 6 and connected to an ink tank (not shown). Provided on a surface (a bottom surface) of the ink flowpath component 6 opposite the pressure chamber component 5 is a nozzle plate 13 formed of an electro-cast plate of stainless steel or Ni or of polymeric resin of polyimide, et cetera having a thickness of from 20 μm to 50 μm. Formed in the nozzle plate 13 is a nozzle aperture 14 connected to the ink flowpath 8. Each nozzle aperture 14 is disposed on a straight line extending in the direction in which the recessed portions 2 are arranged.

Provided, in a corresponding manner to the recessed portion 2, on a surface (a top surface) of the pressure chamber component 5 of the head main body 1 opposite the ink flowpath component 6 is a piezoelectric actuator 21. Each piezoelectric actuator 21 has a vibration plate 22 which blocks up the recessed portion 2 of the head main body 1 so as to form, together with the recessed portion 2, the pressure chamber 3. The vibration plate 22 is common to all the piezoelectric actuators 21 and serves also as a lower electrode common to all piezoelectric elements 23 which will be described later. Each piezoelectric actuator 21 has a piezoelectric element 23 and a Pt upper electrode 24 having a thickness of from 0.1 μm to 0.3 μm. The piezoelectric element 23 is provided, in a corresponding manner to the pressure chamber 3, on a portion (a portion facing the opening of the recessed portion 2) of a surface (a top surface) of the vibration plate 22 opposite the head main body 1 and is formed of lead zirconium titinate (PZT). The Pt upper electrode 24 is provided on a surface (a top surface) of the piezoelectric element 23 opposite the vibration plate 22 for the application of voltage to the piezoelectric element 23. The area of each of surfaces of the upper electrode 24 in the thickness direction thereof is set slightly below that of the piezoelectric element 23 or may be made identical with that of the piezoelectric element 23. Further, an insulator 25 formed of photoresist material or photosensitive polyimide is formed between the adjoining piezoelectric elements 23 and between the adjoining upper electrodes 24.

The piezoelectric element 23 of the piezoelectric actuator 21 is applied a voltage through the vibration plate 22 as the lower electrode and the upper electrode 24. By the piezoelectric effect of the piezoelectric element 23, a portion of the vibration plate 22 corresponding to the pressure chamber 3 deforms, thereby causing the ink in the pressure chamber 3 to be emitted out of the emission opening 2*b*. In other words, when a pulse-like voltage is applied between the vibration plate 22 and the upper electrode 24, the piezoelectric element 23 sandwiched therebetween shrinks in the crosswise direction perpendicular to the thickness direction, whereas neither the vibration plate 22 nor the upper electrode 24 shrinks. Therefore, the portion of the vibration plate 22 corresponding to the piezoelectric element 23 is deflected and deformed by the so-called bimetal effect, being formed into a convex shape toward the pressure chamber 3. This deflection/deformation generates a pressure in the inside of the pressure chamber 3. By this pressure, a specified amount of the ink in the pressure chamber 3 is emitted, by way of the emission opening 2*b* and the ink flowpath 8, to the outside (onto a sheet of paper on which printing is performed) from the nozzle aperture 14. The ink thus emitted is deposited on the paper surface in the form of a dot.

Instead of emitting a single color of ink from the nozzle aperture 14, different kinds of ink colors such as black, cyan, magenta, and yellow may be emitted from respective nozzle apertures 14 for achieving color printing.

Figure 4:
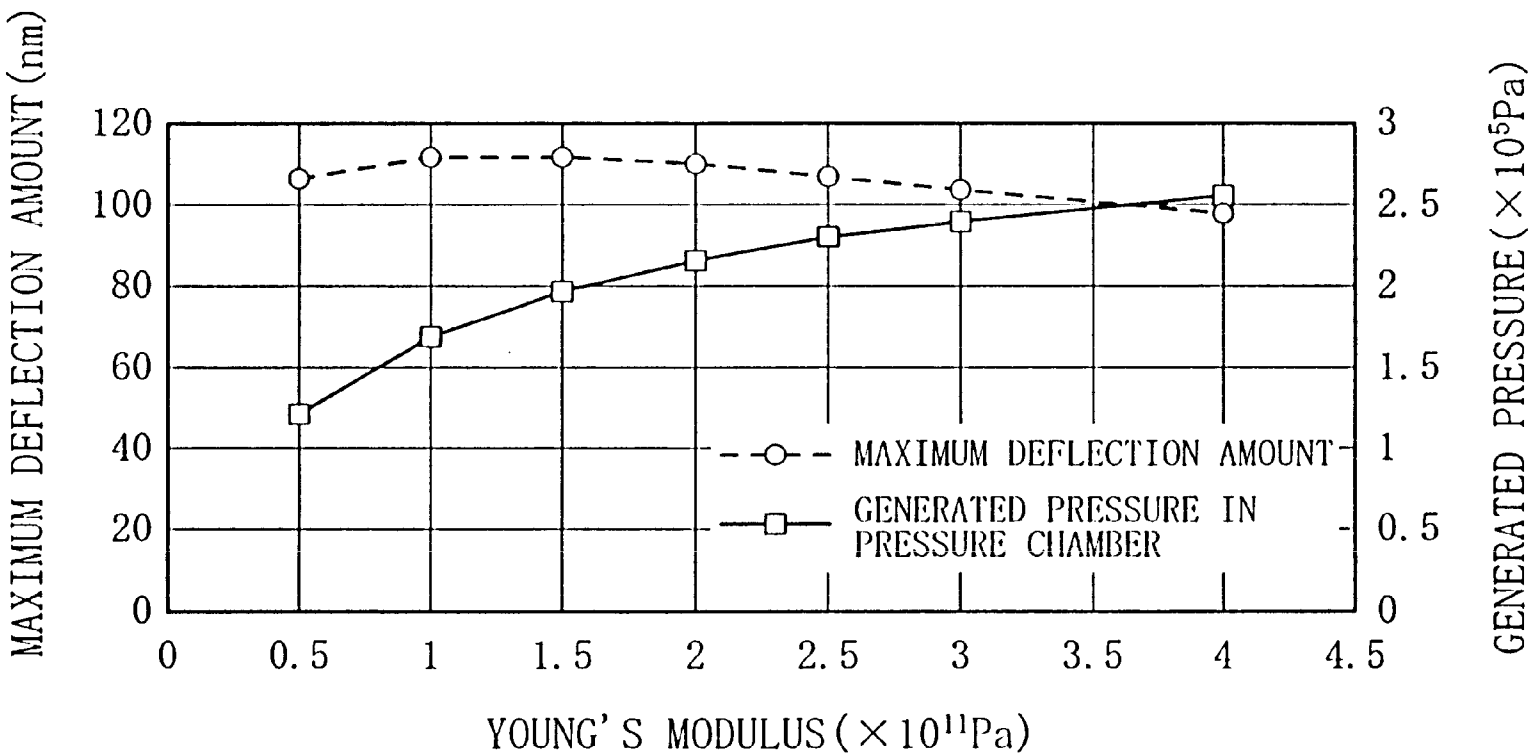
FIG. 4 graphically shows a relationship of the Young's modulus of a vibration plate with respect to the maximum deflection amount and to the pressure generated in a pressure chamber.
Figure 5A:
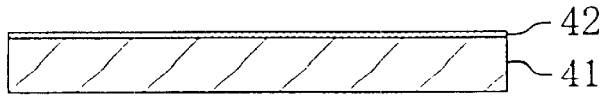
FIG. 5 is a schematic explanatory diagram of a method for the manufacture of the ink jet head of the first embodiment.
Figure 5B:
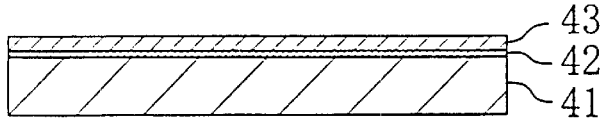
Figure 5C:
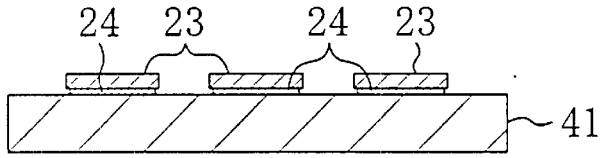
Figure 5D:
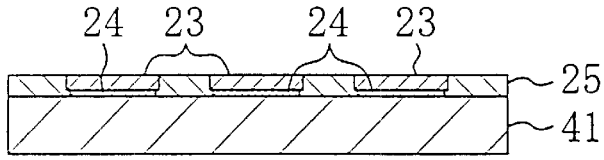
Figure 5E:
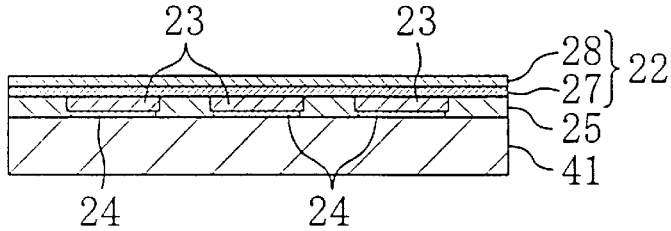
Figure 5F:
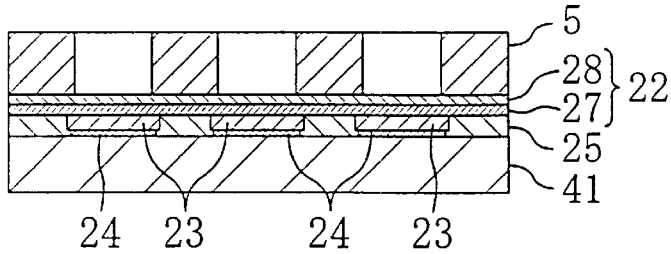
Figure 5G:
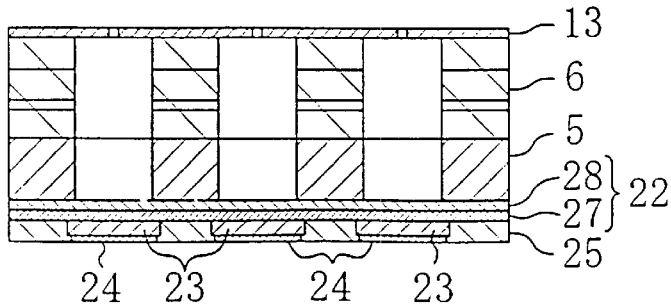

The vibration plate 22 of the piezoelectric actuator 21 is formed by lamination of two layers having different Young's moduli, i.e., a layer 27 having a smaller Young's modulus and a layer 28 having a greater Young's modulus, in the thickness direction of the vibration plate 22. In the first embodiment, the great Young's modulus layer 28 underlies the small Young's modulus layer 27, being disposed nearer to the head main body 1 than the small Young's modulus layer 28. Preferably, the Young's modulus of each of the layers 27 and 28 is set at values ranging from 50 GPa to 350 GPa. The reason is as follows. If the Young's modulus of each of the layers 27 and 28 is set below 50 GPa, this results in insufficient ink emission rates because the pressure generated in the pressure chamber 3 is low, although the amount of deflection necessary for achieving ink emission is sufficient, as shown in FIG. 4. Additionally, it is required to increase the total thickness of the vibration plate 22 above 7 μm, producing problems which will be described later. On the other hand, if the Young's modulus is set above 350 GPa, the vibration plate 22 comes to have difficulties in being bent although the pressure generated is increased to a sufficient extent, and sufficient deflection amounts cannot be obtained.

Moreover, it is preferable that the total thickness of the vibration plate 22 be set at values ranging from 1 μm to 7 μm. The reason is as follows. If the total thickness of the vibration plate 22 is set below 1 μm, there are produced difficulties in securing the strength of the vibration plate 22 and the pressure generated in the pressure chamber 3 becomes low. On the other hand, if the total thickness is set above 7 μm, this may result in film debonding and cracking at the time of the manufacture of the ink jet head which will be described later and the amount of deflection for achieving ink emission is insufficient. In the case that the total thickness of the vibration plate 22 is set at values ranging from 1 μm and to 7 μm, the thickness of the piezoelectric element 23 is also set preferably at values ranging from about 1 μm to about 3 μm so that the piezoelectric element 23 is easily deflected. Desirably, the thickness of each of the small and great Young's modulus layers 27 and 28 of the vibration plate 22 is set at values ranging from about 1 μm to about 3 μm.

Further, it is preferable that at least the great Young's modulus layer 28 of the vibration plate 22 (i.e., the layer nearmost the head main body 1) is made of a material having ink corrosion resistance. The ink corrosion resistant material is made of one of simple substances of copper, nickel, chromium, titanium, molybdenum, stainless steel, and tungsten, one of oxides, nitrides, and carbides of the simple substances, or an alloy selected from a group of alloys containing the simple substances, respectively. Furthermore, it is preferable that the small Young's modulus layer 27 is also made of a material having ink corrosion resistance different from the one forming the great Young's modulus layer 28. Particularly, if the small Young's modulus layer 27 is made of titanium (Young's modulus: 117 GPa) or copper (Young's modulus: 124 GPa) and the great Young's modulus layer 28 is made of chromium (Young's modulus: 248 GPa), this provides the vibration plate 22 superior in various aspects such as ink emission performance, strength, productivity, et cetera.

Next, a procedure of the manufacture of the above-described ink jet head will roughly be described with reference to FIG. 5. In FIG. 5 the vertical positional relationship of the ink jet head is opposite to FIGS. 1 and 2.

First, a Pt film 42 is formed all over a film formation substrate 41 of MgO by sputtering (see FIG. 5(*a*)). Following this, a PZT film 43 is formed all over the Pt film 42 by sputtering (see FIG. 5(*b*)). Then, the Pt film 42 and the PZT film 43 are patternized (i.e., individualized) by RIE (Reactive Ion Etching) to form an upper electrode 24 and a piezoelectric element 23, respectively (see FIG. 5(*c*)). Sputtering is the technique of forming a thin film by making utilization of a phenomenon (called "sputter") in which when a solid body (a target body) is radiated with high energy particles, target forming atoms are ejected from the target surface. The sputter technique includes various types such as high frequency sputtering, DC sputtering, et cetera depending on the electrode structure and the way of generating particles for the sputtering. Any type of sputtering may be employed.

Thereafter, either photoresist material or photosensitive polyimide resin is filled between the adjoining upper electrodes 24 and between the adjoining piezoelectric elements 23 by means of a spin coater to form the insulator 25 (see FIG. 5(*d*)). At this time, the top surface of the insulator 25 is made substantially coplanar with the top surface of the piezoelectric element 23 by a photolithography technique.

Next, the small Young's modulus layer 27 of the vibration plate 22 is formed, by sputtering, on the piezoelectric element 23 and on the insulator 25. Following this, the great Young's modulus layer 28 is formed on the small Young's modulus layer 27 by sputtering thereby to complete the vibration plate 22 (see FIG. 5(*e*)).

Next, the great Young's modulus layer 28 of the vibration plate 22 and the pressure chamber component 5 defining the pressure chamber 3 in the head main body 1 are adhered together (wherein an aperture for the pressure chamber 3 is pre-opened) (see FIG. 5(*f*)). This is followed by melting/removal of the film formation substrate 41 by thermophosphoric acid, KOH, or the like, and the ink flowpath component 6 and the nozzle plate 13 are sequentially adhered onto the pressure chamber component 5 (see FIG. 5(*g*)). Prior to adhering together the great Young's modulus layer 28 of the vibration plate 22 and the pressure chamber component 5, the ink flowpath component 6 and the nozzle plate 13 may be pre-adhered to the pressure chamber component 5.

Although not diagrammatically shown, the ink jet head is completed by providing wiring to each upper electrode 24 and to the vibration plate 22 and by performing other necessary processing.

When melting and removing the film formation substrate 41, thermophosphoric acid or KOH may reach and damage the piezoelectric element 23 in the absence of the insulator 25. However, in the present embodiment, by virtue of the insulator 25 and the upper electrode 24, the piezoelectric element 23 is prevented from being exposed to thermophosphoric acid or KOH.

Although the insulator 25 may be removed posterior to melting and removing the film formation substrate 41, it is better to leave the insulator 25 than removing it because of the following reasons (1) and (2).

(1) Since the modulus of elasticity of photoresist or photosensitive polyimide resin is not more than about 1/20 of that of PZT (1/33 according to the measurement), the insulator 25 will not prevent the piezoelectric actuator 21 from operating even when the insulator 25 is left intact.

(2) By virtue of the insulator 25, the piezoelectric actuator 21 can be protected from mechanical external force resulting from some undesirable happening or maloperation and, in addition, the transmission of stress between the vibration plate 22 whose modulus of elasticity is high and the peripheral sidewall of the piezoelectric element 23 can be smoothed, thereby making it possible to improving the life of the piezoelectric element 23.

In the first embodiment, the vibration plate 22 is made up of two layers, i.e., the small Young's modulus layer 27 and the great Young's modulus layer 28, having different Young's moduli (or made of different materials) from each other. Therefore, when the layers 27 and 28 are formed, they exhibit different internal stresses (strains), and in the entire vibration plate 22 the internal stresses (strains) are cancelled. As a result, excessive stress concentration to the vibration plate 22, the piezoelectric element 23, et cetera can be suppressed.

Figure 6:
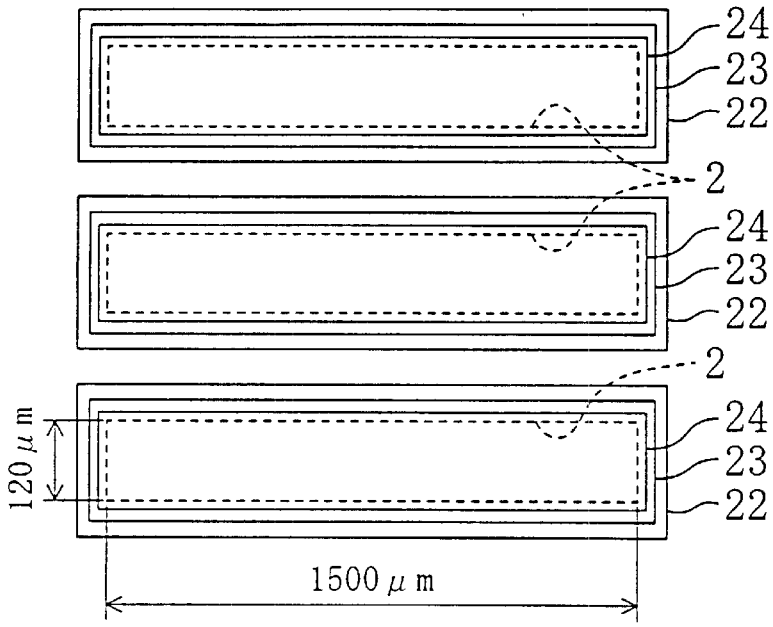
FIG. 6 is a partially enlarged top plan view of the ink jet head showing the opening dimensions of a recessed portion of a head main body.

For example, as shown in FIG. 6 (in which the vibration plates 22 are individually provided for the respective piezoelectric actuators 21 and the insulator 25 is not provided), in the case that the dimensions of the opening of each recessed portion 2 of the head main body 1 is 120 μm×1500 μm, and that the vibration plate 22, formed to be slightly greater than the recesses portion's 2 opening, is composed of only chromium, the vibration plate 22 is distorted convexly to the side opposite to the pressure chamber 3 (the upper side), and the maximum distortion amount (the maximum warping amount) ranges from 0.5 μm to 1.5 μm. On the other hand, if the vibration plate 22 is made up of two layers, i.e., the small Young's modulus layer 27 of titanium and the great Young's modulus layer 28 of chromium, the maximum distortion amount ranges from 0.1 μm to 0.5 μm, thereby reducing the distortion amount of the entire vibration plate 22.

Figure 7:
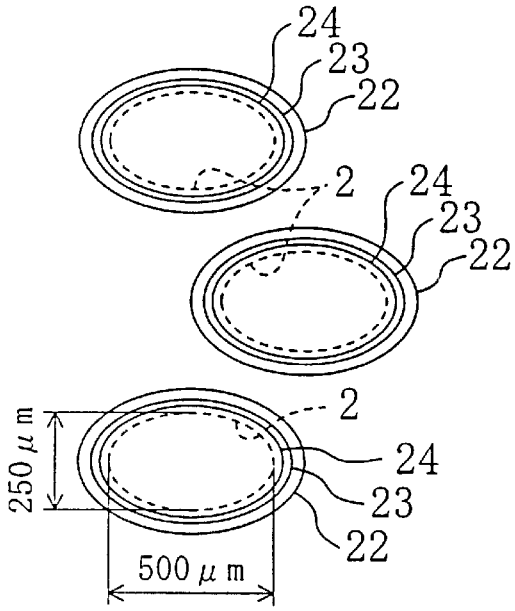
FIG. 7 is a diagram corresponding to FIG. 6, showing an example in which the opening of the recessed portion of the head main body and a piezoelectric actuator are formed into an elongated circular shape.

Further, as shown in FIG. 7, in the case that the opening of the recessed portion 2 of the head main body 1 is formed into an elongated circular shape (an elliptical shape) of about 250 μm (minor axis)×about 500 μm (major axis), and that the vibration plate 22, the piezoelectric element 23, and the upper electrode 24 are each formed into an elongated circular shape corresponding to the recessed portion 2, if the vibration plate 22 is made of only chromium, the maximum distortion amount of the vibration plate 22 toward the side opposite to the pressure chamber 3 becomes considerable great, i.e., from 5 μm to 15 μm, and on the other hand, if the vibration plate 22 is made up of two layers, i.e., the small Young's modulus layer 27 of titanium and the great Young's modulus layer 28 of the chromium, the maximum distortion amount becomes considerably small, i.e., from 0.5 μm to 4 μm.

Accordingly, when manufacturing the ink jet head, none of cracking, film debonding, and film expansion will occur in the vibration plate 22 and the piezoelectric element 23, thereby improving the productivity. Additionally, even when the ink jet head is used for a long time, the vibration plate 22, the piezoelectric element 23, et cetera are unlikely to undergo cracking, thereby increasing the life of the ink jet head. These effects will be demonstrated more effectively when, as described above, the opening of the recessed portion 2 of the head main body 1 and the piezoelectric actuator 21 are formed into an elongated circular shape.

In the first embodiment, the vibration plate 22 is made up of two layers having different Young's moduli from each other, i.e., the small Young's modulus layer 27 and the great Young's modulus 28. However, the vibration plate 22 may be made of three or more layers having different Young's moduli from one another.

Further, in the first embodiment, the great Young's modulus layer 28 is disposed nearer to the head main body 1 than the small Young's modulus layer 27. On the other hand, the small Young's modulus layer 27 may be disposed nearer to the head main body 1 than the great Young's modulus layer 28.

Embodiment 2

Figure 8:
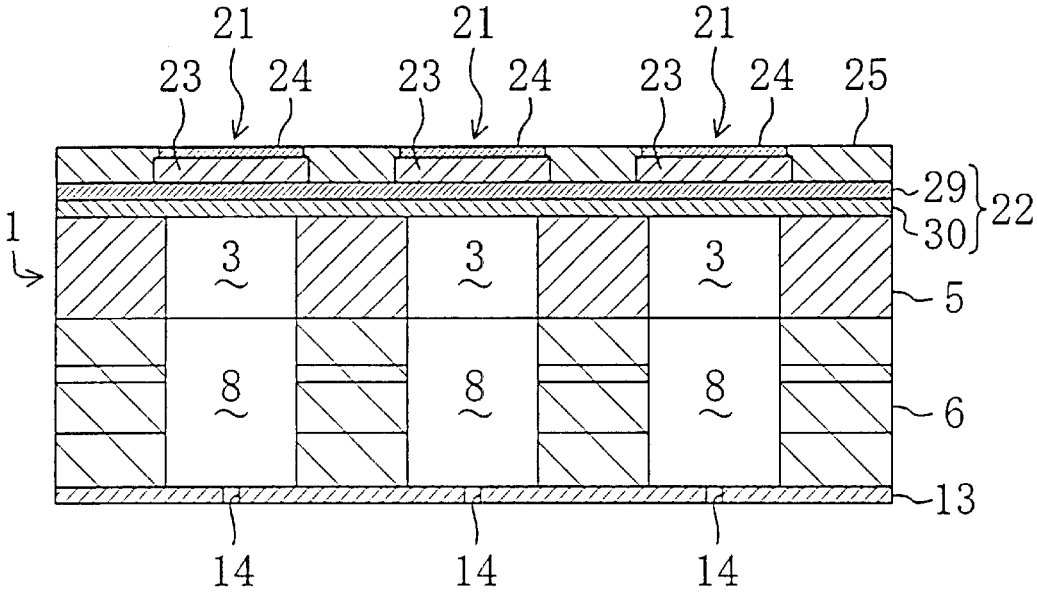
FIG. 8 is a diagram corresponding to FIG. 1, showing an ink jet head according to a second embodiment of the present invention.
Figure 9:
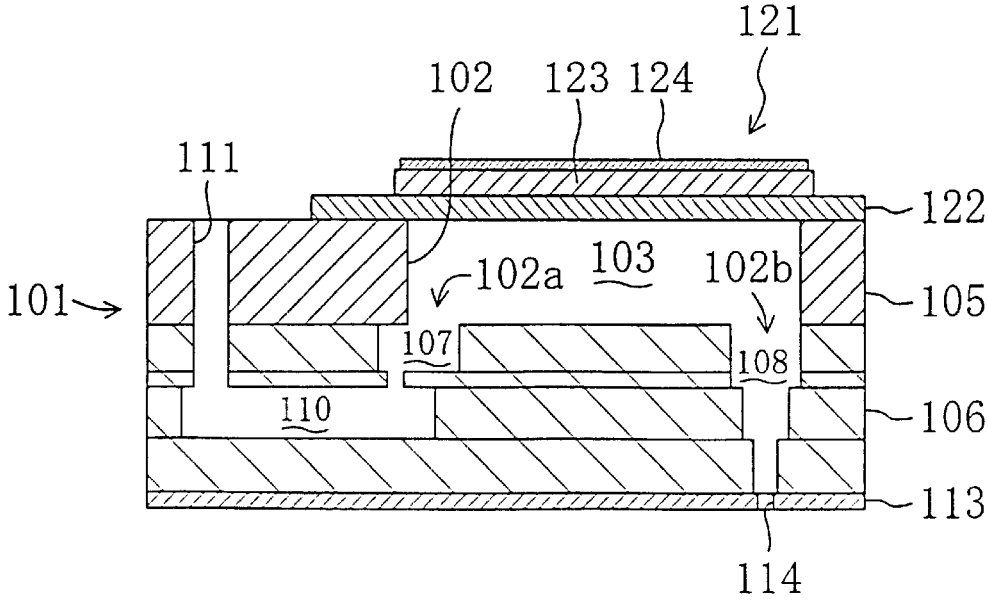
FIG. 9 is a cross-sectional view of a conventional ink jet head when cut off in the lengthwise direction of a piezoelectric element (taken along line IX—IX of FIG. 10).
Figure 10:
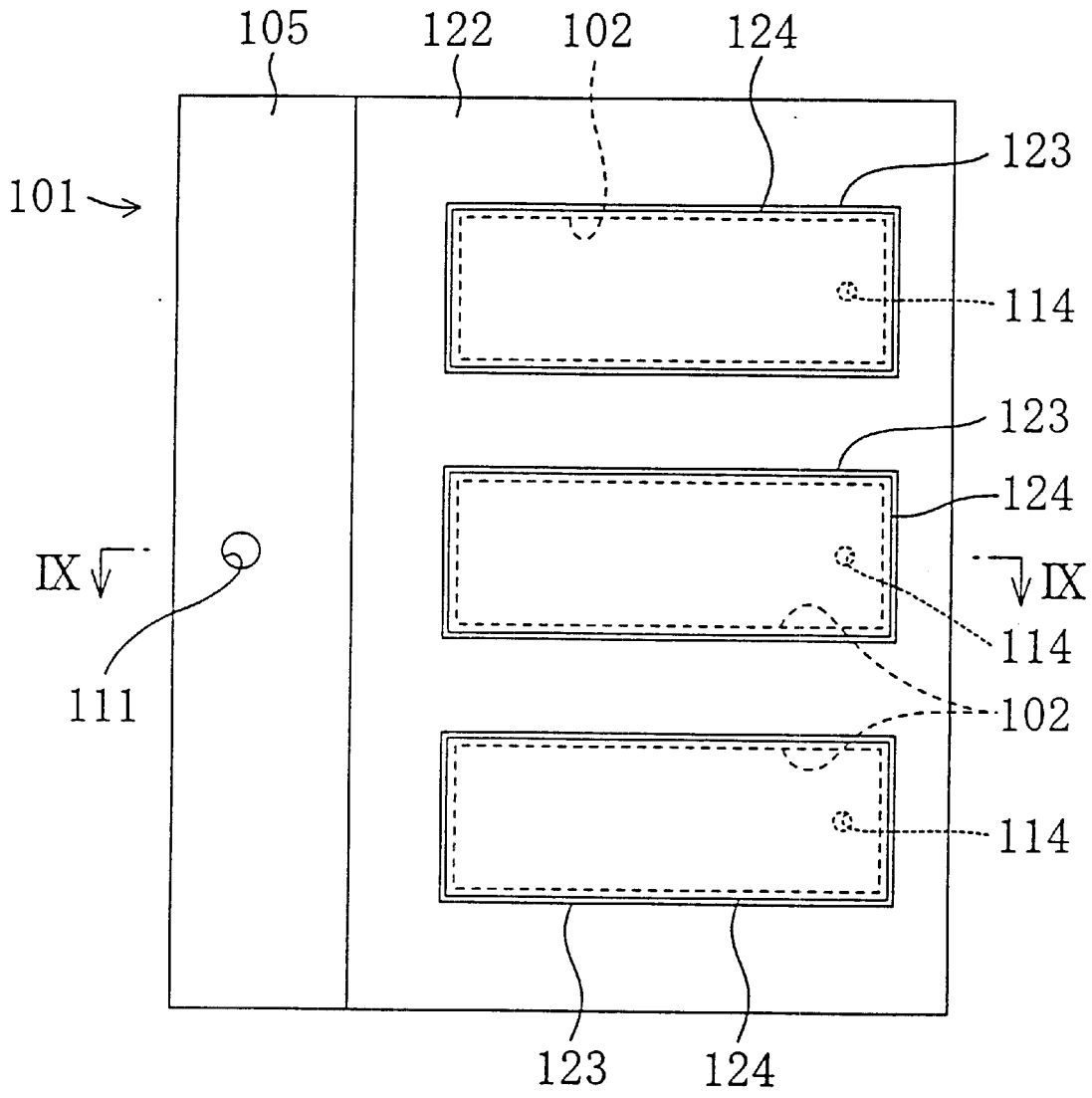
FIG. 10 is a top plan view of the conventional ink jet head.

Referring to FIG. 8, there is shown a second embodiment of the present invention (in which the same components as shown in FIG. 1 have been assigned the same reference numerals and therefore their description will be omitted), and in the second embodiment the structure of the vibration plate 22 of the piezoelectric actuator 21 differs from the first embodiment.

In the second embodiment, the vibration plate 22 is formed by laminating together, in the thickness direction of the vibration plate 22, a single compressive residual stress layer 29 having a compressive residual stress and a single tensile residual stress layer 30 having a tensile residual stress, and the tensile residual stress layer 30 is disposed nearer to the head main body 1 than the compressive residual stress layer 29. Preferably, the residual stress of the compressive residual stress layer 29 is set below 300 GPa (not less than −300 GPa when the compressive and tensile sides of the stress are represented by − and by +, respectively), while the residual stress of the tensile residual stress layer 30 is set below 200 GPa (not more than +200 GPa when the compressive and tensile sides of the stress are represented by − and by +, respectively). The reason is that if the residual stress of the compressive residual stress layer 29 is greater than 300 GPa (i.e., smaller than −300 GPa), then the compressive stress is excessively increased, resulting in breakage of the film formation substrate 41 and the occurrence of cracking and film debonding in the vibration plate 22. On the other hand, if the residual stress of the tensile residual stress layer 30 is greater than 200 GPa, then the film becomes cloudy or is colored black, failing to become a normal mirror finished film and therefore being incapable of functioning as a vibration plate.

It is preferable that both the compressive residual stress layer 29 and the tensile residual stress layer 30 are made of the same material having ink corrosion resistance (more specifically, the ink corrosion resistant material is composed of one of simple substances of copper, nickel, chromium, titanium, molybdenum, stainless steel, and tungsten, one of oxides, nitrides, and carbides of the simple substances, or an alloy selected from a group of alloys containing the simple substances, respectively, as in the first embodiment), more preferably, chromium. Further, as in the first embodiment, preferably the total thickness of the vibration plate 22 is set at values ranging from 1 μm to 7 μm and the thickness of the piezoelectric element 23 is set at values ranging from about 1 μm to about 3 μm.

A method for the manufacture of the above-described ink jet head will be explained below. This manufacture method is the same as the first embodiment except the formation step of the vibration plate 22. Therefore, only the formation step of the vibration plate 22 will be explained omitting the overlapping description.

The insulator 25 is formed between the adjoining upper electrodes 24 and between the adjoining piezoelectric elements 23. Thereafter, the compressive residual stress layer 29 of the vibration plate 22 is formed on the piezoelectric element 23 and on the insulator 25 by sputtering. Following this, the tensile residual stress layer 30 is formed atop the compressive residual stress layer 29 by sputtering. When forming both the residual stress layers 29 and 30 by sputtering, their film stress can adequately be controlled by changing parameters, such as the temperature of the film formation substrate 41, sputter gas pressure, sputter power, TS interval (the target/substrate distance), of various sputter conditions. Particularly, if the sputter gas pressure is controlled, this makes it possible to achieve easy control of the film stress.

More specifically, in the case that both the residual stress layers 29 and 30 are made of chromium and a high frequency sputter device (frequency: 13.56) is employed, the compressive residual stress layer 29 can be formed using the following conditions that the target diameter is 8 inches, the sputter power is 500 W, the temperature of the film formation substrate 41 is room temperature, and the sputter argon gas pressure is set at values ranging from 1 mTorr to 5 mTorr (from 0.13 Pa to 0.67 Pa), and the tensile residual stress layer 30 can be formed when the sputter argon gas pressure is set at values ranging from 8 mTorr to 12 mTorr (from 1.07 Pa to 1.60 Pa)

Further, in the case that both the residual stress layers 29 and 30 are made of other than chromium, the value of the film stress with respect to the sputter gas pressure slightly differs from the above chromium case. However, basically, the relationship between the sputter gas pressure and the film stress is substantially the same as the above chromium case, so that if the sputter gas pressure is controlled this makes it possible to easily control the film stress of the residual stress layers 29 and 30.

The film stress values of the residual stress layers 29 and 30 can be found as follows. That is, a thin film is formed on a thin substrate (18 mm×4 mm and 0.1 mm thick) whose Young's modulus and Poisson's ration are known, the amount that the substrate warps is measured, and the film stress of the thin film formed on the substrate is calculated from a bending beam law relational expression to find values of the film stress of the residual stress layers 29 and 30. Whether the stress is a compressive or a tensile residual stress can be determined by whether the thin film formed on the substrate becomes concave or convex.

The optimum value of the thickness ratio of the compressive residual stress layer 29 and the tensile residual stress layer 30 correlates with the opening shape (the length-width ratio) of the recessed portion 2 of the head main body 1, and it is sufficient that the film thickness ratio of the compressive residual stress layer 29 to the tensile residual stress layer 30 is so set as to range from ⅕ to ½ according to the recessed portion's 2 opening shape. If the film thickness of the compressive residual stress layer 29 deviates from such a range and therefore becomes excessively thick, components, such as the vibration plate 22, the piezoelectric element 23, and the upper electrode 24, undergo cracking, film debonding, and film expansion when forming the vibration plate 22 and after removing the film formation substrate 41. This results not only in the drop in ink jet head productivity but also in the drop in ink jet head's mechanical strength when being used, which may lead to the drop in ink jet head's life.

In the second embodiment, the vibration plate 22 is made up of the compressive residual stress layer 29 and the tensile residual stress layer 30, because of which arrangement the vibration plate 22 will be prevented from being formed by crystal growth in one direction, thereby relaxing strain generated from in-crystal defect and opening gap and suppressing the occurrence of film debonding. As a result, the acceptable good ratio at the ink jet head manufacture will be improved and, in addition, the ink jet head life will be increased. Therefore, the second embodiment provides the same operational effects as the first embodiment. The formation of the residual stress layers 29 and 30 are carried out by control of the sputter gas pressure in a sputter technique, thereby making it possible to easily and correctly control the in-film stress state of the residual stress layers 29 and 30, and the vibration plate 22 can be formed easily at high yield.

In the second embodiment, the single compressive residual stress layers 29 and the single tensile residual stress layer 30 are provided. However, any one of these layers 29 and 30 may be provided plurally or both of them may be provided plurally. In this case, these plural compressive residual stress layers 29 or these tensile residual stress layers 30 may differ in residual stress value from each other or may be the same, and the order in which they are laminated is not limited to a particular one. The residual stress layers 29 and 30 are not necessarily made of the same material and may be made of different materials. The compressive residual stress layer 29 may be disposed nearer to the head main body 1 than the tensile residual stress 30.

Further, in each of the first and second embodiments, the vibration plate 22 is common to all the piezoelectric actuators 21. However, like the piezoelectric element 23 and the upper electrode 24, the vibration plate 22 may individually be provided for each piezoelectric actuator 21.

Furthermore, in each of the first and second embodiments, the vibration plate 22 serves also as a lower electrode. However, a separate lower electrode may be provided between the vibration plate 22 and the piezoelectric element 23.

Additionally, in each of the first and second embodiments, the opening shape of the recessed portion 2 of the head main body 1 and the piezoelectric element 23 of the piezoelectric actuator 21 are formed into a rectangular shape. However, as described in the first embodiment, they may be formed into an elongated circular shape or an elliptical shape or may be formed into other shapes.

Further, other various variations may be possible to make. For example, the piezoelectric element 23 of the piezoelectric actuator 21 and the upper electrode 24 may be different in material and thickness from the first and second embodiments and may be formed by other manufacture methods. Further, the pressure chamber component 5 of the head main body 1, the ink flowpath component 6, and the nozzle plate 13 may be different in material and thickness from the first and second embodiments.

INDUSTRIAL APPLICABILITY

The ink jet head and its manufacture method of the present invention are useful when used in ink jet printers for computers, facsimile machines, photocopiers, et cetera. Particularly, the present invention is capable of miniaturizing ink jet heads and improving their productivity and reliability as high as possible and therefore its industrial applicability is high.

What is claimed is:

1. A method for the manufacture of an ink jet head in which ink in a pressure chamber is emitted by causing a vibration plate to undergo deformation by the piezoelectric effect of a piezoelectric element, said ink jet head manufacture method comprising the steps of:

forming on a substrate an electrode and said piezoelectric element in a superposed manner with said electrode disposed nearer to said substrate;

forming on said piezoelectric element said vibration plate by laminating together at least one compressive residual stress layer having a compressive residual stress and at least one tensile residual stress layer having a tensile residual stress in the thickness direction of said vibration plate by a sputter technique;

adhering together said vibration plate and a pressure chamber component defining said pressure chamber; and after said adhering step, removing said substrate.

2. The ink jet head manufacture method of claim 1, wherein the residual stress of said compressive residual stress layer of said vibration plate is set at 300 GPa or below, and wherein the residual stress of said tensile residual stress layer of said vibration plate is set at 200 GPa or below.

3. The ink jet head manufacture method of claim 1, wherein said compressive and tensile residual stress layers of said vibration plate are formed by control of the pressure of a sputter gas.

4. A method for the manufacture of an ink jet head in which ink in a pressure chamber is emitted by causing a vibration plate to undergo deformation by the piezoelectric effect of a piezoelectric element, said ink jet head manufacture method comprising the steps of:

forming an electrode and said piezoelectric element in a superposed manner;

forming said vibration plate adjacent to said piezoelectric element by laminating together at least one compressive residual stress layer having a compressive residual stress and at least one tensile residual stress layer having a tensile residual stress in the thickness direction of said vibration plate by a sputter technique; and forming a pressure chamber adjacent to said vibration plate and on a side opposite to said piezoelectric element.

* * * * *